US007874804B1

(12) United States Patent
Brown

(10) Patent No.: US 7,874,804 B1
(45) Date of Patent: Jan. 25, 2011

(54) TURBINE BLADE WITH DETACHED PLATFORM

(75) Inventor: Wesley D. Brown, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 868 days.

(21) Appl. No.: 11/801,594

(22) Filed: May 10, 2007

(51) Int. Cl.
*F01D 5/30* (2006.01)

(52) U.S. Cl. ..... 416/193 A; 416/248

(58) Field of Classification Search ..... 416/248, 416/193 A, 219 R, 244 A, 204 A
See application file for complete search history.

(56) References Cited

U.S. PATENT DOCUMENTS 2,767,460 A * 10/1956 Schultz ..... 416/248
2,825,530 A 3/1958 Schum et al.
3,479,009 A * 11/1969 Bean ..... 416/193 A
3,801,222 A * 4/1974 Violette ..... 416/193 A
4,334,827 A 6/1982 Bouiller et al.
4,802,824 A 2/1989 Gastebois et al.
4,813,850 A * 3/1989 Partington ..... 416/193 A
5,030,063 A 7/1991 Berger
5,222,865 A * 6/1993 Corsmeier ..... 416/193 A
5,399,069 A 3/1995 Marey et al.
6,447,250 B1 * 9/2002 Corrigan et al. ..... 416/193 A
7,284,958 B2 * 10/2007 Dundas et al. ..... 416/193 A
7,510,379 B2 * 3/2009 Marusko et al. ..... 416/230

* cited by examiner

*Primary Examiner*—Richard Edgar
(74) *Attorney, Agent, or Firm*—John Ryznic

(57) ABSTRACT

A turbine blade with a detached platform in which the platform has a central opening in which the blade is inserted and held in place. The blade includes a root portion with a fir tree configuration to fit within a slot of a rotor disc. The platform includes two legs that also have a fir tree configuration to fit within the slot of the rotor disc. The blade is inserted into the central opening and the fir tree configurations of the blade root and the platform legs form substantially an aligned set of fir trees that fit within the rotor disc slot to retain both the blade and the platform within the slot. The blade is therefore separated from the platform such that thermal stresses are uncoupled. Also, the blade can be made from a different material than is the platform. The centrifugal load applied to the platform is not transferred onto the blade.

2 Claims, 4 Drawing Sheets

View A-A

TURBINE BLADE WITH DETACHED PLATFORM

CROSS-REFERENCE TO RELATED APPLICATIONS

This application is related to a co-pending U.S. Regular patent application Ser. No. 11/715,042 filed on Mar. 6, 2007 and entitled COMPOSITE BLADE AND PLATFORM ASSEMBLY.

BACKGROUND OF THE INVENTION

1. Field of the Invention

The present invention relates generally to fluid reaction surfaces, and more specifically to a platform and blade assembly for use in a turbine of a gas turbine engine.

2. Description of the Related Art Including Information Disclosed Under 37 CFR 1.97 and 1.98

Rotor blades in an axial flow compressor or turbine used in a gas turbine engine have a rotor disk with a plurality of dove-tail or fir-tree slots formed in the disk in which a blade root having a similar cross section shape is placed in order to secure the blade to the rotor disk and hold the blade against the high centrifugal forces that develop during operation of the engine. The turbine blades typically include platforms that extend between adjacent blades and form an inner shroud for the gas flow through the blades. Stresses induced by the high rotor speeds concentrate at the fir tree slots and can be minimized by minimizing the mass of the blade.

Nickel base super-alloys are widely used in applications where high stresses must be endured at elevated temperatures. One such application is the field of gas turbine engines where nickel base super-alloys are widely used especially for blades and vanes. Demands for improved efficiency and performance have resulted in the operation of turbine engines at increasingly elevated temperatures placing extreme demands on the superalloy articles used therein.

One approach to improve the temperature capabilities of nickel based super-alloys is to fabricate the blades in the form of single crystals. Conventionally prepared metallic materials include a plurality of grains which are separated by grain boundaries which are weak at elevated temperatures, much weaker than the material within the grains. Through specific casting techniques, nickel based super-alloys can be produced in single crystal form which have no internal grain boundaries. U.S. Pat. No. 4,719,080 issued to Duhl et al on Jan. 12, 1988 and entitled ADVANCED HIGH STRENGTH SINGLE CRYSTAL SUPERALLOY COMPOSITIONS shows a prior art single crystal turbine blade, the entire disclosure of which is incorporated herein by reference. A single crystal blade will have higher strength in the radial direction of the blade which will result in better creep strength and therefore longer blade life.

Recent casting technologies have made the casting process for a single crystal blade at about the cost of casting a non-single crystal blade. However, casting process for single crystal blades produces a larger number of defective casts than does the non-single crystal casting process. This results in the casting process for the single crystal blades to be much higher. One major reason why this is so is that the single crystal blades are cast with the blade platforms formed with the airfoil portion. The platforms extend from the airfoil portion at substantially 90 degree angles from the blade spanwise direction. Since the single crystal orientation is along the spanwise direction of the blade (to provide for the higher blade strength and creep resistance), extending the single crystal growth of the blade airfoil out along the platform results in a lot of defects in the casting process. It would be beneficial to therefore from a single crystal blade with the platform formed separately in order to decrease the number of defective single crystal blades.

The current state of the art for casting high temperature resistant turbine blades is to cast the blade as one piece with the internal cooling passages formed during the casting process. The internal cooling passages are formed by placing a ceramic core having the shape of the cooling passages within a mold in which the blade is cast. This is a very expensive process for making an air cooled turbine blade because the failure rate is high due to core shift or core breakage during the casting process.

In some prior art turbine rotor disks used in gas turbine engines, the turbine blades have been formed from ceramic composites in order to allow for higher gas flow temperatures in the turbine section. The ceramic blades were formed with fir tree shaped roots for insertion in the fir tree slots of the metallic rotor disk. However, this manner of securing the blade to the rotor requires the blade root to be capable of withstanding high tensile forces. Ceramic materials are capable of withstanding high compressive forces, but not high tensile forces.

The prior art U.S. Pat. No. 5,030,063 issued to Berger on Jul. 9, 1991 and entitled TURBOMACHINE ROTOR discloses a rotor for an axial flow compressor or turbine in a gas turbine engine in which the rotor disk includes a plurality of fir tree shaped slots in which a turbine blade is secured within, and a ring that has airfoil shaped slots in which the blades extend through so that the ring forms a cylindrical platform for the gas flow through the blades in the assembled rotor disk. The ring an annular short flange and an annular long flange integral with the ring and on opposite sides of the cylindrical platform. The Berger invention separates the platforms from the blades so that the radial forces acting on the platform are transferred to the rotor disk instead of through the blades. However, in the assembly is used in the turbine section of a gas turbine engine, the extreme high temperatures would produce high thermal stresses on the annular flanges that would shorten the life of the ring. The lower edge of the annular long flange would be exposed to about 700 degrees C. while the upper edge would be exposed to about 1200 degrees C., resulting in a temperature gradient in this part of about 500 degrees C. which would cause very high thermal stresses in the part.

U.S. Pat. No. 3,801,222 issued to Violette on Apr. 2, 1974 and entitled PLATFORM FOR COMPRESSOR OR FAN shows a compressor blade that is fabricated into two complementary separate halves adapted to surround the root of each blade to define the blade platform in which the blade and the platform both have portions that slide into a dovetail of the rotor disc. In the Violette patent, the platform is detached from the blade.

It is therefore an object of the present invention to provide for a turbine rotor disk with a single crystal blade with a platform formed as a separate attachment to the blade in which the thermal stresses would be acceptable for low cycle fatigue (LCF) and longer life.

It is another object of the present invention to provide for a turbine rotor disk with blades made from a single crystal superalloy with a lower number of defective blades made in the casting process.

It is another object of the present invention to provide for a turbine rotor disk in which the rotor blades are made from a ceramic material and attached to a rotor disk made from a metallic material, in which the ceramic blade is secured to the rotor disk and blade platforms through compression forces with very little tensile forces.

It is another object of the present invention to provide for a turbine rotor disk with blades made from a single crystal superalloy with a platform separate from the blade and secured to the rotor disc in order that the loads from the platform are not passed onto the blade.

BRIEF SUMMARY OF THE INVENTION

The present invention is a turbine blade with a platform separate from the blade in which both the blade and the platform are supported within a slot of the rotor disc. The blade is formed as a separate piece from the platform, and the platform is formed as a single piece with a hole formed therein having a shape of the airfoil so that the blade fits within the platform opening. The blade includes a root with a fir tree configuration that fits within a slot formed in the rotor disc. The platform includes two legs located on the forward and aft sides of the platform, each having a fir tree configuration in which the platform also fits within the slot of the rotor disk. When the blade is fitted within the opening of the platform, the fir tree root and platform legs form a fir tree configuration to fit the blade and platform assembly within a standard slot of a rotor disc. Because of the composite assembly of the blade and platform, the blade can be made from a single crystal material without the casting defects of the one piece blades of the prior art. Also, the stress level at the junction between the blade airfoil and the platform in a single piece blade can be eliminated due to the detachment of the platform from the blade. The platform can also be made from a different material than the blade.

DETAILED DESCRIPTION OF THE INVENTION

Figure 1:
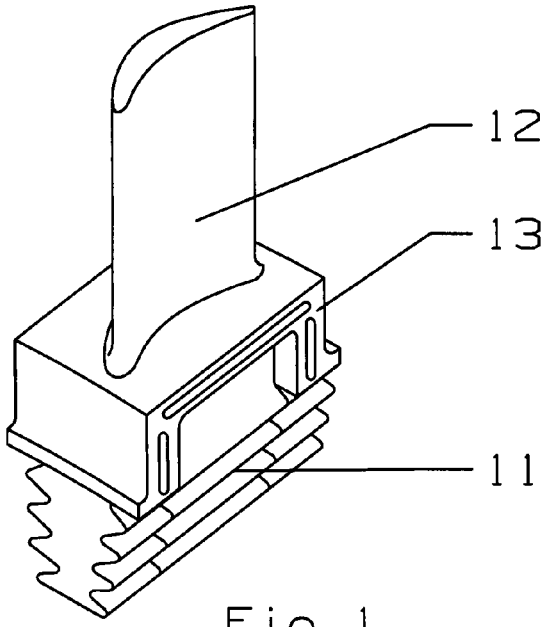
FIG. 1 shows a schematic view of a turbine blade with a separate platform of the present invention.

The present invention is a turbine blade with a platform that is used in a rotor disk of a gas turbine engine. The blades include platforms that form a flow path for the hot gas flow passing through the turbine blades. FIG. 1 shows a schematic view of the turbine blade of the present invention. The blade includes a root portion 11 that includes a standard fir tree configuration for placement within a slot of a rotor disk and an airfoil portion 12. The platform portion 13 includes two legs 14 and 15 that extend from the bottom of the platform and have the same fir tree configuration as does the root 11. The platform 13 includes a central opening 16 sized and shape to accept the blade airfoil portion. The opening 16 has the size and shape of the airfoil portion of the blade such that as little of a gap is left between the platform 13 and the airfoil 12 when the two pieces are assembled together. the central opening 16 forms a complete opening within the hot gas flow surface of the platform without any gaps formed between two piece platform sections such as that found in the prior art Violette patent.

Figure 2:
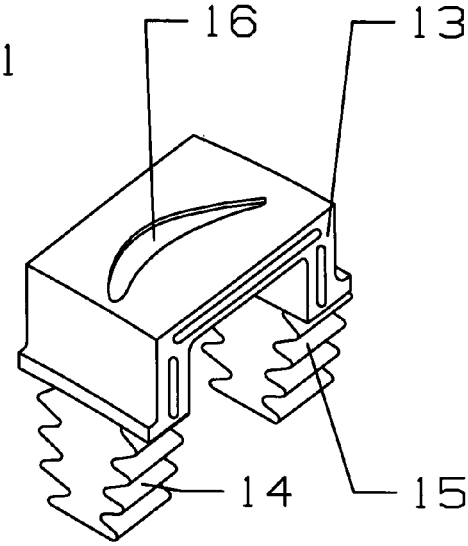
FIG. 2 shows a schematic view of a turbine blade platform of the present invention.
Figure 3:
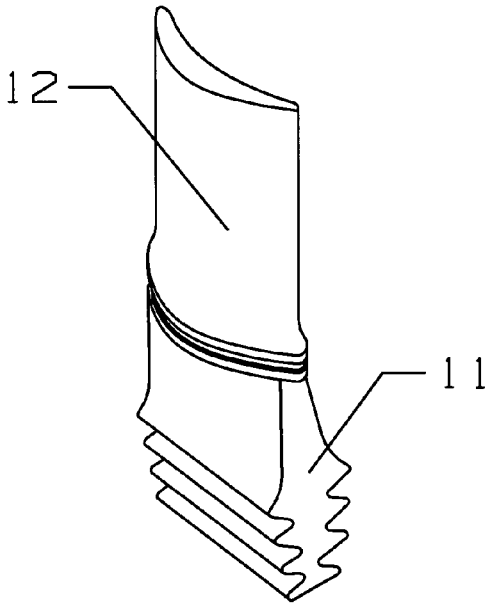
FIG. 3 shows a schematic view of a single piece turbine blade used in the present invention.

The FIG. 2 shows a view of the platform 13 with the forward and aft legs 14 and 15 extending from the platform. FIG. 3 shows the blade with the airfoil 13 and the root 13 extending from the root in which the root includes a similar fir tree configuration as does the legs of the platform. The legs 14 and 15 and the root 11 each have a fir tree configuration such that when the blade and the platform are assembled, the legs and the root form substantially one fir tree without gaps that can slide within the slot of the rotor disc as would the prior art single piece blade. The composite blade assembly (the airfoil and root portion and the platform) of the present invention has the same size and shape of the single piece turbine blades with fir tree configuration of the prior art, but with the two piece form. Thus, the two piece composite blade of the present invention can fit within the slot of a standard rotor disc without modification. A seal is also placed within one or more grooves formed within the blade or the platform to provide for a seal to prevent the hot gas flow from passing between the gap formed between the blade and the central opening of the platform.

In the preferred embodiment, the blade is made from a single crystal superalloy such as that described in U.S. Pat. No. 4,719,080 issued to Duhl et al on Jan. 12, 1988 and entitled ADVANCED HIGH STRENGTH SINGLE CRYSTAL SUPERALLOY COMPOSITIONS. Single crystal superalloy blades have higher strength than metallic blades, and thus improved creep resistance. This leads to longer blade life. However, the blade can be made of other materials such as nickel based super alloys.

Separating the blade from the platform provides a number of benefits over the single piece turbine blade of the prior art. The high stress levels developed within the single piece blade at the junction between the airfoil and the platform is eliminated in the present invention having the two piece blade assembly. As a result, the composite turbine blade of the present invention can have a longer service life. Also, the airfoil portion of the blade can be made from a single crystal material without the casting defect problems of the prior art blades that have the platform cast integral with the airfoil. A lower manufacturing cost is produced by the composite blade assembly of the present invention because the platform is not cast along with the blade airfoil portion. The single crystal airfoil also allows for the blade to operate under higher gas flow temperatures and also to have a longer life cycle fatigue.

The platform 21 can be made from a metallic or ceramic material different from that of the blade depending upon the situation. The airfoil 12 of the blade is exposed to the hot gas flow of the turbine all around the airfoil portion. Thus, a lower thermal gradient exists in the airfoil. The platform, however, is exposed to the hot gas flow on the flow side while the underside is exposed to cooling air. A much higher thermal gradient exists on the platform 13 that on the airfoil 12. Thus, the platform 13 can be made from a material different than that of the airfoil 12 such that the large thermal gradient can be countered. The single piece platform with the central opening for the airfoil and the two legs extending downward on opposite sides from the blade root 11 also provides for a more rigid blade assembly than does the earlier cited Violette patent. A more rigid blade assembly will allow for higher rotational speeds using the same materials, or allow for less material to be used in forming the blade assembly under the same rotational speeds. Thus, a more efficient turbine is created. High rotational speeds produce higher pull on the slot and fir tree configuration. Using blades made from less weight will reduce the pulling force and allow for lighter weight turbine rotor discs.

The fir tree shaped blade root and platform legs can have any well known rotor disc slot engagement shape as long as the blade and platform legs can be slid into the rotor disc slot and held against radial displacement during rotor disc operation. Each of the platform legs can have the same size and shape or have one of the legs thicker in order to take into account of different loads acting on each of the two aft legs.

Figure 4:
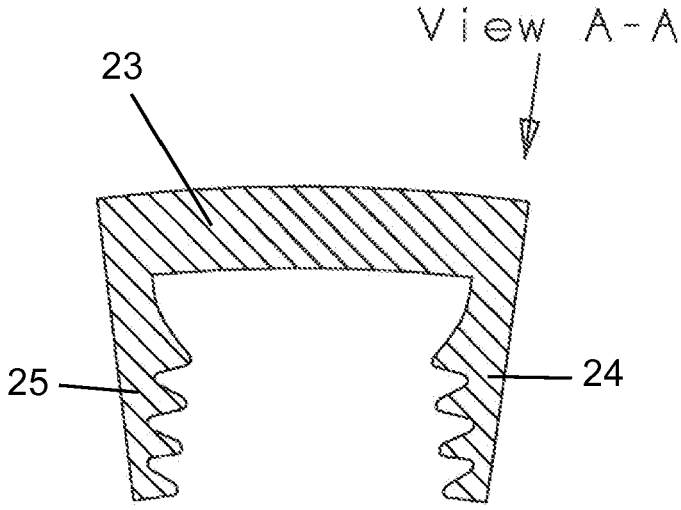
FIG. 4 shows a front cross sectional view of a second embodiment of the platform of the present invention.
Figure 5:
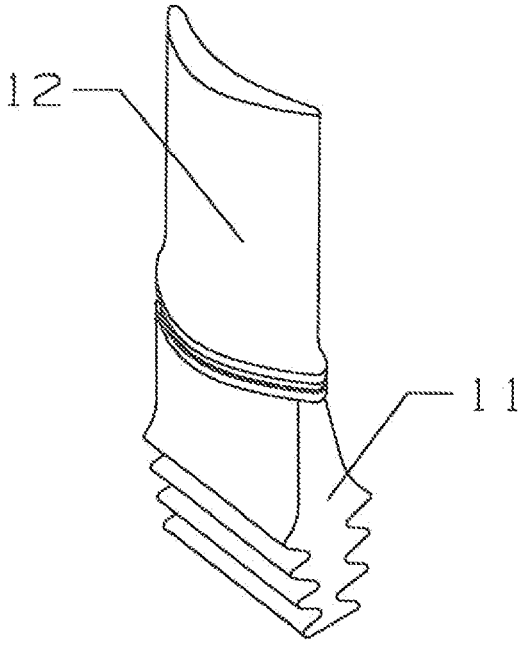
FIG. 5 shows a turbine blade used with the platform of the second embodiment of the present invention.
Figure 6:
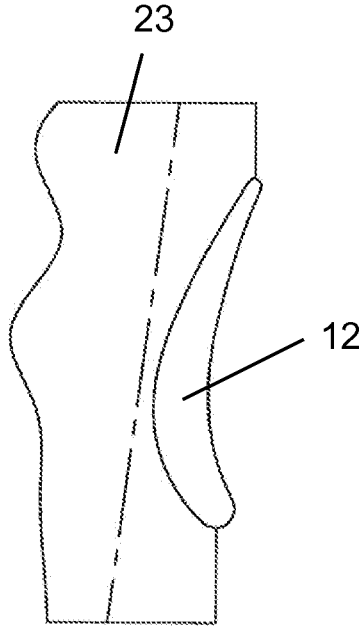
FIG. 6 shows a top cross sectional view of the right side of FIG. 4.

A second embodiment of the present invention is shown in FIG. 4 in which the platform can secure more than one blade as in the first embodiment of FIG. 1. In the FIG. 4 embodiment, the platform segment 23 includes legs 24 and 25 extending from underneath that form one half of a fir tree configuration. When a second platform segment is placed adjacent to the first platform segment, the two abutting fir tree halves 24 and 25 will form a full fir tree for insertion into a rotor disc slot. A turbine blade as seen in FIG. 5, with an airfoil portion 12 and the root portion 11 having the fir tree configuration, will slide into the central opening of the platform segment 23 in between the front leg and the aft leg of the platform, just like in the FIG. 1 embodiment. FIG. 6 shows a top view of the platform segment 23 of FIG. 4 on the right side. The airfoil body 12 is shown in FIG. 6 with the dashed line representing the fir tree from below the platform segment 23. When two platform segments 23 are abutting to each other, the central opening is formed having the complete airfoil shape.

Figure 7:
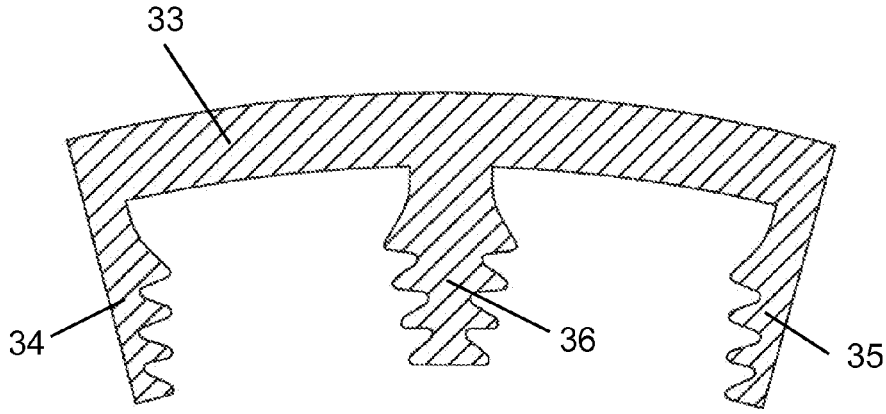
FIG. 7 shows a front cross sectional view of a third embodiment of the platform of the present invention.

A third embodiment of the present invention is shown in FIG. 7 in which the platform segment 33 is used to secure three turbine blades. The platform segment 33 is shown in FIG. 7 having one half of a fir tree 34 and 35 extending from below on the ends, while a full fir tree extension 36 extends from below in the center of the platform. As in the FIG. 4 embodiment, when two platform segments 33 are adjoined together, the two half fir tree configuration form a single fir tree for insertion into the rotor disc slot. The turbine blade of FIG. 3 or FIG. 5 is inserted into the central opening formed between adjacent platform segments 33 on the ends or into the central opening formed in the middle of the platform segment in between the forward and aft legs of the platform segment 33.

Figure 8:
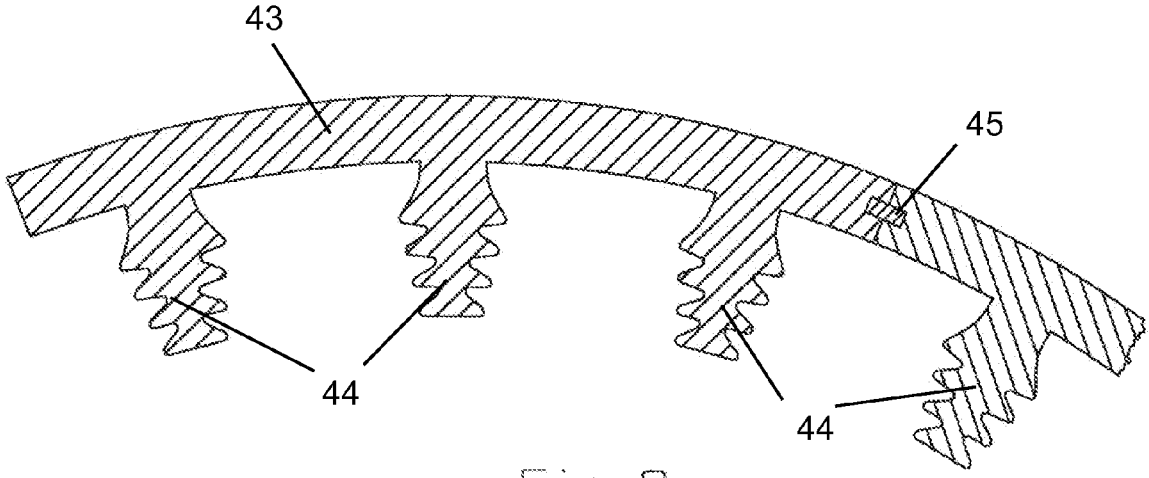
FIG. 8 shows a front cross sectional view of a fourth embodiment of the platform of the present invention.

A fourth embodiment of the present invention is shown in FIG. 8 in which the platform segment 43 includes full shaped fir tree extensions 44 extending from below the platform segment 43. In this embodiment, none of the fir trees 44 extend from the ends of the platform segment 43. Central openings for the turbine blade are formed on the platform surface above the fir trees 44 as in the FIG. 1 embodiment such that the fir trees 44 include a forward leg and an aft leg with the fir tree of the blade root 11 fitted in between the two legs. Adjacent platform segments 43 are sealed and secured against radial displacement by a seal member 45 that fits within slots formed on the platform segment mate faces as seen in FIG. 8.

Figure 9:
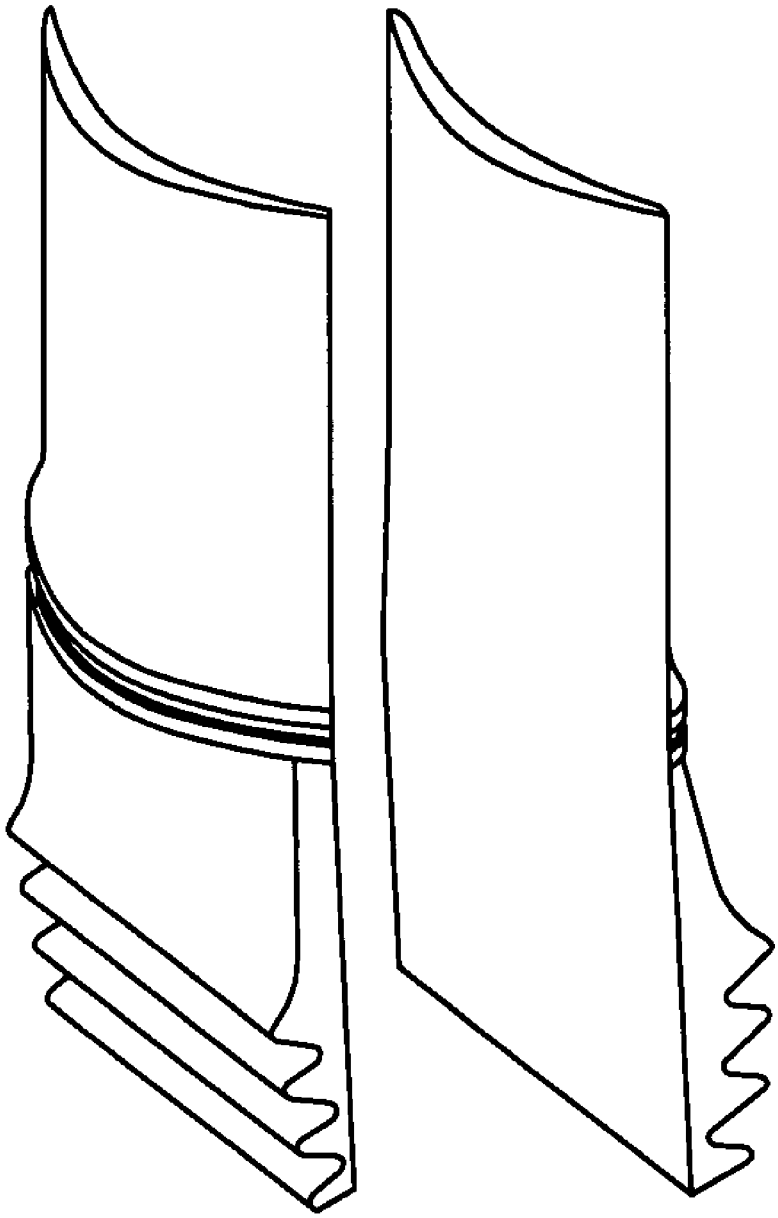
FIG. 9 shows a schematic view of a two piece turbine blade used in the present invention.

FIG. 9 shows a second embodiment for the turbine blade used in the platforms of the present invention. In the FIG. 3 and FIG. 5 embodiment (the same drawing is used for both FIGS. 3 and 5) is a single piece solid turbine blade that is cast with the internal cooling air passages formed into the blade during casting. In the FIG. 9 embodiment, the blade is formed as two pieces with the internal cooling passages on each piece. The two pieces can be easily cast with the cooling passages in this method. The two pieces are then bonded together by any of the well known bonding processes to form a single piece turbine blade.

I claim the following:

1. A multiple piece turbine rotor blade comprising:

an airfoil with a leading edge and a trailing edge with a pressure side wall and a suction side wall both extending between the leading edge and the trailing edge;

a root having a fir tree configuration for insertion into a slot of a rotor disk;

the airfoil and the root are formed as a single piece;

a single piece platform having a pressure wall side and a suction wall side;

the pressure wall side having a curvature equal to a curvature of the pressure wall side of the airfoil;

the suction wall side having a curvature equal to a curvature of the suction wall side of the airfoil;

the pressure wall side of the platform having a forward and an aft half leg both with a fir tree configuration extending from a bottom side;

the suction wall side of the platform having a forward and an aft half leg both with a fir tree configuration extending from a bottom side; and, the single piece airfoil and root are secured between two adjacent single piece platforms in which the two adjacent platforms form a full fir tree configuration aligned with the fir tree configuration of the root.

2. The multiple piece turbine rotor blade of claim 1, and further comprising:

the airfoil and the root are formed from a single crystal material.

* * * * *